United States Patent [19]

Juguin et al.

[11] B 3,992,465

[45] Nov. 16, 1976

[54] PROCESS FOR MANUFACTURING AND SEPARATING FROM PETROLEUM CUTS AROMATIC HYDROCARBONS OF HIGH PURITY

[75] Inventors: Bernard Juguin; Georges Cohen, both of Rueil-Malmaison; Paul Mikitenko, Chatou, all of France

[73] Assignee: Institut Francais du Petrole, Rueil-Malmaison, France

[22] Filed: Jan. 2, 1974

[21] Appl. No.: 430,157

[44] Published under the second Trial Voluntary Protest Program on February 17, 1976 as document No. B 430,157.

[30] Foreign Application Priority Data

Jan. 10, 1973 France ..... 73.00806

[52] U.S. Cl. ..... 260/668 D; 208/64; 208/65; 208/96; 208/102; 260/674 SE

[51] Int. Cl.[2] ..... C07C 5/36

[58] Field of Search ..... 208/313, 102, 96, 64, 208/65; 260/668 D, 674 SE

[56] References Cited

UNITED STATES PATENTS

| | | | |
|---|---|---|---|
| 2,834,822 | 5/1958 | Worthington et al. | 208/313 |
| 2,877,173 | 3/1959 | Thorne et al. | 208/96 |
| 2,969,317 | 1/1961 | Hess | 208/96 |
| 3,551,327 | 12/1970 | Kelly et al. | 208/313 |

*Primary Examiner*—Herbert Levine
*Attorney, Agent, or Firm*—Millen, Raptes & White

[57] ABSTRACT

Process for producing aromatic hydrocarbons, particularly benzene and/or toluene from a feed charge containing saturated and unsaturated hydrocarbons, by catalytic treatment of said charge with hydrogen, fractionation of the resulting product to separate a fraction containing benzene and/or toluene, extractive distillation of at least one aromatic hydrocarbon in a column, by means of an extraction solvent from which said hydrocarbon is subsequently separated, and recycling to the reaction zone of at least one portion of the products recovered at the top of said extractive distillation column and containing essentially $C_6$ and $C_7$ saturated hydrocarbons.

7 Claims, 1 Drawing Figure

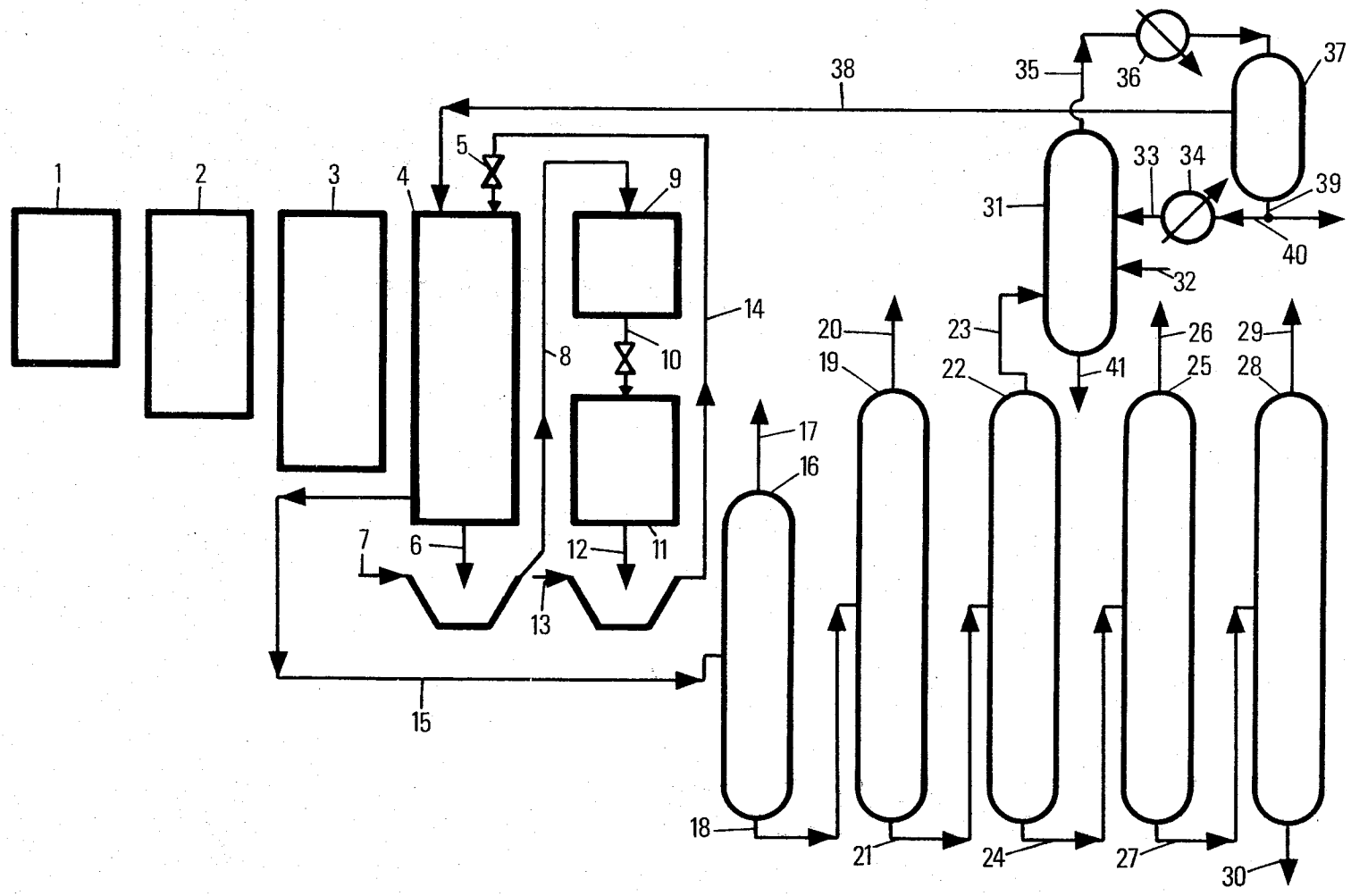
1
2
3
4
5
6
7
8
9
10
11
12
13
14
15
16
17
18
19
20
21
22
23
24
25
26
27
28
29
30
31
32
33
34
35
36
37
38
39
40
41

PROCESS FOR MANUFACTURING AND SEPARATING FROM PETROLEUM CUTS AROMATIC HYDROCARBONS OF HIGH PURITY

This invention concerns a process for producing aromatic hydrocarbons and subsequently separating benzene and/or toluene from the mixtures obtained, said separation process making use of an extractive distillation zone.

By aromatic hydrocarbon production, it is meant for example the production of bezene, toluene and xylenes (ortho, meta or para), either from unsaturated or saturated gasolines, for example pyrolysis gasolines, cracking gasolines, particularly obtained by stream-cracking or by catalytic reforming or still from naphthenic hydrocarbons which may be converted by dehydrogenation to aromatic hydrocarbons, or also from paraffinic hydrocarbons which may be converted to aromatic hydrocarbons by dehydrocyclisation.

In the case where the aromatic hydrocarbons are produced from gasolines, either unsaturated or not, the operating conditions may be those given below, although they are not limitative of the scope of the invention.

First of all, in the case of an unsaturated hydrocarbon charge, i.e. a charge containing diolefins and monoolefins, this charge must preliminarily be made free therefrom, for example by selective hydrogenation whereby the diolefins and alkenylaromatics are converted to monoolefins and alkylaromatics respectively, in the presence of a conventional hydrogenation catalyst or of a mixture of such catalysts, for example a metal, a sulfide or an oxide of a metal from groups VI and/or VIII, for example tungsten, molybdenum, nickel, cobalt or palladium, preferably nickel. The reaction conditions depend on the type of catalyst used. The temperature may be from −20° to 250°C, the pressure from 1 to 90 kg/cm$^2$ and the hydrogen feed from 0.2 to 3 moles per mole of hydrocarbon charge. Subsequently, after separation of the $C^5$ hydrocarbons and of the hydrocarbons having a number of hydrocarbon atoms higher than 8, the $C_6$–$C_7$–$C_8$ cut is subjected to a hydrogenation-hydrodesulfurization, whereby the monoolefins are converted to paraffins, and the charge is desulfurized in the presence of a catalyst which may be the same as in the preceding step and which is preferably a cobalt-molybdenum catalyst, said catalyst being preferably deposited on a non-cracking support, for example alumina. This step is conducted at a temperature from 250° to 450°C under a pressure of from 10 to 80 kg/cm$^2$ with 0.2 to 3 moles or more of hydrogen per mole of charge. The sulfur content of the product obtained at the outlet of the reactor must not be greater than about 20 parts per million of parts by weight in order not to spoil the catalyst of the following step.

The charge substantially freed of diolefins and monoolefins, if any, and which generally consists essentially of saturated paraffinic anc naphthenic hydrocarbons and aromatic hydrocarbons, is then sent to at least one reaction zone where it is subjected to a treatment with hydrogen in the presence of at least one catalyst containing at least one metal selected from metals of groups VIII, VI B and VII B of the periodic classification of elements, at a temperature from about 400° to 600° C and which will be further examined below, under a pressure from 1 to 60 kg/cm$^2$, the hourly flow rate by volume of the liquid charge being of about 0.1 to 10 times the catalyst volume, the molar ratio hydrogen/hydrocarbons being from about 0.5 to about 20. The catalyst used is a bi-functional catalyst, i.e. a catalyst having an acid function (the support) and a dehydrogenating function; the acid function is obtained by acid compounds such as alumina and chlorinated and/or fluorinated alumina or other similar compounds such as alumina-silica, magnesia-silica, thoria-silica, magnesia-alumina etc ... The dehydrogenating function is achieved by at least one metal from group VI B, VII B and VIII of the periodic classification of elements such as platinum, iridium, ruthenium, palladium, rhodium, osmium, nickel, cobalt, rhenium, tungsten and molybdenum, either sulfurized or not, deposited on an acid support. Optionally, there can be used, in addition, another metal such as gold or silver, copper, cadmium, germanium, tin. The best results are obtained by associating these different metals by pairs or even by three; particular associations being as follows :

platinum and iridium
platinum and ruthenium
platinum and rhenium
ruthenium and tungsten
platinum and tungsten
iridium and rhenium
iridium and ruthenium
rhenium and tungsten
platinum and molybdenum
iridium and tungsten
ruthenium and rhenium
molybdenum and rhenium
platinum, iridium and ruthenium
iridium, rhenium and ruthenium
platinum, rhenium and tungsten
platinum and manganese The dehydrogenating metal or metals contained in the catalyst amount generally to about 0.01 to 5 % by weight, advantageously about 0.05 to 1% and preferably about 0.10 to 0.6 %. The catalyst may further contain up to about 10 % by weight of halogen.

The atomic ratio between the main metal and the one or more associated metals may be selected at will.

The textural characteristics of the acid catalyst support are also important; in order to proceed at relatively high spatial velocities and to avoid the use of reactors of a too large capacity and the use of an excessive amount of catalyst, the specific surface of the support is selected from 50 to 600 m$^2$/g, preferably from 150 to 400 m$^2$/g. During this treatment of the charge with hydrogen :

the iso and normal paraffins are mainly cracked to propane, butane and isobutane, to a lesser extent to pentane, isopentane, hexane and isohexane and subsidiarily to ethane and methane, the naphthenes are dehydrogenated to aromatics and provide the hydrogen amount required for cracking the paraffins, the aromatics are substantially unchanged.

The process of the invention is conducted in at least one reaction zone. When a single reaction zone is used, the inlet temperature in said reaction zone is from about 555° to 600°C, preferably from 560° to 590°C, and more particularly from 570° to 585°C.

In the case of use of several reaction zones, the inlet temperature in the last reaction zone is from 555° to 600°C preferably from 560° to 590°C, particularly from 570° to 585°C, the inlet temperature in the other reaction zones being either selected within the same range as above indicated for the temperature of the last reaction zone or selected within the range of conventional inlet temperatures for reforming reactions, i.e. from 480° to 500°C, for example from 490° to 540°C.

The use of a relatively high temperature in the reaction zone when a single reaction zone is used or in at least the last reaction zone in the case of use of several reaction zones, provides for the completion of the aromatization of the products whereby the octane number of the obtained product is increased and the qualities of the produced benzene, toluene and xylenes are also substantially improved.

In order to maintain a relatively high temperature as compared to the conventional temperatures normally used in reforming reactions, it is generally necessary, in the reaction zone operated at high temperature, to progressively withdraw the catalyst from said reaction zone and to simultaneously introduce relatively fresh catalyst into said zone.

By the term "progressively" it is meant that the catalyst may be withdrawn:

either periodically for example at intervals of from 1/10 to 10 days, by withdrawing at the same time only one fraction, for example 0.5 to 15 %, of the total catalyst amount. However it is also possible to withdraw this catalyst at a much more rapid frequency (for example of the order of the minute or the second), the withdrawn amount being accordingly reduced, or in a continuous manner.

In order to progressively withdraw the catalyst from the reaction zone, and to simultaneously introduce relatively fresh catalyst into said elementary catalyst zone, the catalyst may be a granulated catalyst having for exxmple the shape of spherical balls of a diameter from about 1 to 3 mm, preferably from 1.5 to 2 mm, the density in bulk of this solid being from about 0.5 to 0.9 and more particularly from 0.6 to 0.8. The catalyst bed, in the form of an uninterrupted column of catalyst grains, slowly descends (in the following description such zone will be conventionally called "moving bed type zone").

In the case of use of a single reaction zone, operated at high temperature, the catalyst progressively withdrawn from the reaction zone is generally sent to a regeneration zone, at the outlet of which the regenerated catalyst is fed back to the reaction zone. The regeneration of the catalyst is carried out by any known means. For example, the regeneration may be performed according to the teaching of the U.S. patent specification Ser. No. 305,797 filed on Nov. 13, 1972.

Generally the catalyst, after regeneration, is first reduced in the presence of a hydrogen stream, before being progressively reintroduced at the end of the reaction zone opposite to that from which the catalyst has been withdrawn.

In the case of several reaction zones, we can use two reaction zones but generally, we use three or even four reaction zones. The charge circulates successively through each of said reaction zones and is subjected to an intermediary heating between said zones. As above mentioned, the last reaction zone is always of the moving bed type; whereas the other reaction zones may be, according to the circumstances, either all of the fixed bed type or all of the moving bed type or still at least one of said other zones may be of the moving bed type and the others of the fixed bed type.

When in a system of reaction zones, only the last catalyst zone operated at high temperature is of the moving bed type, the catalyst progressively withdrawn from said zone is regenerated and is thereafter progressively reintroduced into said last zone.

When, in the system of reaction zones, all the reaction zones or only a few reaction zones are of the moving bed type, the moving bed type reaction zones may be grouped together so that, as mentioned in the French patent specification No. 71, 41, 069 filed on Nov. 16, 1971, the same catalyst particles circulate through the group formed by said reaction zones: the catalyst is introduced at the top of the first reaction zone of the moving bed type and flows downwardly through said first zone. It is withdrawn from said first reaction zone either continuously or periodically, as explained above, and is fed to the top of the second reaction zone of the moving bed type, through which it flows in the same manner as through the first reaction zone of the moving bed type, and so on, up to the last reaction zone operated at high temperature, from where the catalyst is finally withdrawn, sent to a regeneration zone and the regenerated catalyst is subsequently fed to the top of the first reaction zone of the moving bed type.

In the case of several reaction zones of the moving bed type, these zones may be arranged in series, side by side, each of them containing a catalyst bed slowly flowing downwardly as mentioned above, either continuously or, more generally, periodically, said bed forming an uninterrupted column of catalyst particles. The charge flows through each of the successive zones in an axial direction or in a radial direction from the periphery to the center or from the center to the periphery. These reaction zones being arranged in series, the charge flows successively through each of said reaction zones and is subjected to an intermediary heating between said reaction zones; the catalyst is introduced at the top of the zone where is introduced the fresh feed; it subsequently flows progressively downwardly through said zones from the bottom of which it is withdrawn and, through any convenient means, it is conveyed to the top of the next reaction zone, through which it also flows progressively downwardly and so on up to the last reaction zone from the bottom of which the catalyst is also progressively withdrawn and then sent to the regeneration zone.

In the case of several reaction zones, of the moving bed type, said zones may also be vertically stacked in a single reactor, one above the other, so as to ensure the downward flow of the catalyst by gravity from the upper zone to the next zone below. The reactor then consists of reaction zones of relatively large sections through which the gas stream flows from the periphery to the center or from the center to the periphery (said zones are spaces of the moving bed type) interconnected by catalyst zones of relatively small sections, the gas stream issuing from one catalyst zone of large section being divided into a first portion (preferably from 1 to 10%) passing through a reaction zone of small section for feeding the subsequent reaction zone of large section and a second portion (preferably from 99 to 90 %) sent to a thermal exchange zone and admixed again to the first portion of the gas stream at the inlet of the subsequent catalyst zone of large section.

When using one or more reaction zones with a moving bed of catalyst, said zones as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift". The fluid of the lift used for conveying the catalyst may be any convenient gas, for example nitrogen or still for example hydrogen and more particularly purified hydrogen or recycle hydrogen.

In the case of several reaction zones, a particular arrangement consists in the fact that the last reaction zone through which the charge is passed is of the moving bed type (with a system for regenerating the catalyst progressively withdrawn from said zone and a system for feeding back the regenerated catalyst to the zone of the moving bed type), the other reaction zones being all of the fixed bed type, with the optional possibility of making use of an additional reactor which will be put in operation during the regeneration of the catalyst of one of the fixed bed reactors.

After the treatment of the charge as above-mentioned, the resulting products are made free, through any convenient means (for example by stripping) of normally gaseous products and are subjected to one or more conventional fractionations in order to obtain various cuts containing ethylbenzene, xylenes and $C_9^+$ hydrocarbons and a $C_6$ and/or $C_7$ cut containing benzene (benzene fraction) and/or toluene (toluene fraction) according to the contemplated object.

By benzene fraction it is meant a mixture of benzene with hydrocarbons whose lower boiling point is at least about 65°C and the higher boiling point at most about 102°C. For example, it may be a mixture of benzene with saturated hydrocarbons, essentially those containing from 6 to 8 carbon atoms. However, the invention may be applied to benzene cuts containing lighter hydrocarbons.

By toluene fraction, it is meant for example a mixture of toluene with saturated hydrocarbons whose lower and upper boiling points are in the interval between substantially the final boiling point of the benzene fractions (about 102°C) and about 120°C. It must be mentioned that, when it is desired for example to maximize the benzene production, it is advantageous to recycle at least one portion of the toluene to the zone of hydrogen treatment of the charge, and, when it is desired for example to maximize the production of xylenes, it is advantageous to recycle at least one portion of the $C_9^+$ cut to the zone of hydrogen treatment of the charge (when using several reactors for performing the hydrogen treatment of the charge, these recycled products are generally fed to the last of the reactors traversed by the charge).

The production of pure benzene and/or pure toluene from benzene and/or toluene fractions, cannot be achieved by mere distillation since these aromatic hydrocarbons form azeotropes with some of the other hydrocarbons or have boiling points too close to one another, for making it possible to separate them efficiently.

In the present process, the separation of benzene and/or toluene ($C_6$ and/or $C_7$ fraction) is achieved by extractive distillation by means of an extraction solvent or a mixture of extraction solvents whereby the hydrocarbons may be fractionated essentially according to the degree of saturation of their molecule and their vapor pressure.

The extractive distillation technique is known per se. It must be recalled that a great number of various extraction solvents, or mixtures thereof have been suggested for carrying out this technique. They are generally the first members of mono or bi-functional polar chemical families. In particular, some industrial plants for aromatic purification make use of phenol, aniline, sulfolane, formylmorpholine, N-methylpyrrolidone etc . . . We may use also compounds of the alkyl-aliphatic amide type and, more particularly, the first members of said family, for example, dimethylformamide, dimethylacetamide.

All of these solvents are generally selected among those having a boiling point higher than that of the less volatile saturated hydrocarbon of the hydrocarbon mixture subjected to the separation step, so as to avoid any hydrocarbon-solvent azeotropy which results in a substantial loss at the top of the extractive distillation column.

The $C_6$ and/or $C_7$ cut, i.e. the hydrocarbon mixture containing the benzene and/or toluene which must be extracted, is therefore introduced into an extractive distillation zone at an intermediary point thereof, preferably at a temperature close, for example, to its bubble point, and the extraction solvent is also introduced at a point of the extractive distillation zone above the point of introduction of the hydrocarbon mixture.

The ratio by volume solvent/hydrocarbon feed is advantageously in the range of 0.4 to 15 and preferably, from 1 to 6. The organic solvent, which is the less volatile compound, essentially in the liquid form, comes to the bottom of the extractive distillation zone, carrying along therewith the aromatic hydrocarbons while changing their volatility with respect to the paraffin or naphthene impurities initially present therewith.

The solvent-aromatic mixture is discharged from the extractive distillation zone and sent to a conventional distillation zone for separating, in a known manner, the solvent from the aromatic hydrocarbons so as to obtain, on the one hand, the recovered extraction solvent and, on the other hand, the aromatic hydrocarbons. At the top of the extractive distillation zone, the non aromatic products (essentially saturated hydrocarbons) are discharged and condensed (to form a condensate). A portion of said condensate may be recycled to the extractive distillation zone.

The extractive distillation technique which is well known has not to be described more in detail.

However, it must be stated that, in some cases, it is advantageous to use the extraction solvent in combination with an associated solvent which generally is water vapor, as mentioned in U.S. patent application Ser. No. 343,108, filed on Mar 20, 1973 now U.S. Pat. No. 3,884,769.

Up to now, non-aromatic hydrocarbons, essentially saturated hydrocarbons, withdrawn from the top of an extractive distillation zone, were condensed, a portion of the condensate being optionally recycled to the extractive distillation zone and the other portion being removed. It has now been discovered and this is an object of the invention, that the present process of producing aromatic hydrocarbons and separating the produced aromatic hydrocarbons is substantially improved when at least one portion of the condensate of the non-aromatic hydrocarbons discharged from the extractive distillation zone is recycled to the aromatic hydrocarbon production zone. When, in the process of producing aromatic hydrocarbons, several reaction zones are used with the feed charge passing through said zones sequentially, the recycled portion of the condensate of non-aromatic hydrocarbons must be recycled at the last zone through which the charge is passed. Before carrying out this recycling, it is first preferred to remove from the recycled portion of the condensate, the traces of the extraction solvent and various impurities (e.g. CO), by any convenient known method, for example by passage over a resin or a molecular sieve, or by water-washing followed with drying, by adsorption or chemical complex forming.

For carrying out reforming processes, it has already been suggested, after the removal of light saturated hydrocarbons ($C_3$–$C_5$), to recycle to the reaction zone, at least one portion of the condensate of the saturated hydrocarbons present in the effluent from the reaction zone, which are essentially $C_6$, $C_7$ and $C_8^+$ saturated hydrocarbons. However, this recycling suffers from drawbacks since, in the presence of relatively heavy saturated hydrocarbons of 8 carbon atoms and more per molecule, the $C_6$–$C_7$ hydrocarbons are not well reformed and disturb the reaction. It has also been suggested to recycle only the relatively heavy saturated hydrocarbons ($C_8^+$), but this process requires a removing of the lighter $C_6$ and $C_7$ saturated hydrocarbons.

On the contrary, by the process of the invention, it is possible to recycle without additional fractionation of the condensate, saturated hydrocarbons recovered from the reaction zone when only one zone is used or from the last one of the reaction zones through which passes the charge when several reaction zones are used. The recycled condensate of saturated hydrocarbons is that obtained from the top of the extractive distillation zone fed with the benzene and/or toluene cut produced in the one or more reaction zones. This recycling is made possible since, according to the present process, the reaction zone where is recycled said condensate (or at least one portion of said condensate) of the saturated hydrocarbons is a zone where the inlet temperature is relatively high (555° to 600°C).

As a matter of fact, when operating under conventional reforming conditions, below about 550°C, a portion of the $C_8^+$ paraffins is not converted and is present in the effluent from the reaction zone or from the last reaction zone (in the case of several reaction zones) in admixture with $C_6$ and $C_7$ unconverted paraffins formed by hydrocracking of the longer paraffins.

The recycling of the whole $C_6$, $C_7$ and $C_8^+$ fraction, gives poor results since, on the one hand, the selective action of the catalyst is only in favour of the conversion of the $C_8^+$ hydrocarbons to aromatics and since, on the other hand, the $C_6$ and $C_7$ hydrocarbons, under the prevailing operating conditions, are essentially cracked, thereby resulting in a strong decrease of the hydrogen yield.

This is the reason why in the reforming processes operated under a conventional temperature, i.e. below about 550°C, it has been suggested to remove from the paraffin fraction the $C_6$ and $C_7$ saturated hydrocarbons before recycling the remainder of said paraffin fraction to the reaction zone.

It might also be contemplated to treat the whole of $C_6$, $C_7$, $C_8^+$ hydrocarbons at a higher temperature for dehydrocyclizing the $C_6$ and $C_7$ present with the $C_8^+$ aromatic hydrocarbons, but by operating at such a higher temperature (mainly with the conventional reforming catalysts as, for example, platinum on alumina), a very substantial decrease of the yield due to the hydrocracking of a portion of the $C_8^+$ and also of the $C_6$ and $C_7$ paraffins, is observed.

In the process of the invention, in which the temperature of the reaction zone or of the last reaction zone, in case of plurality thereof, is higher than 555°C, this catalyst zone containing a specific catalyst, there will be performed in said reaction zone the conversion to aromatics of nearly all the $C_8^+$ paraffins present in the charge, of the most part of the paraffins having 7 carbon atoms per molecule and of a portion of the paraffins having 6 carbon atoms per molecule, so that the effluents from said reaction zone no longer contain $C_8^+$ paraffins but only aromatic hydrocarbons, paraffins having 7 carbon atoms and mainly paraffins having 6 carbon atoms as well as $C_5^-$ paraffins and hydrogen, in contrast with the effluents of the conventional reforming processes or of the processes for producing aromatics, whose $C_8^+$ paraffin content is still high.

Thus, in the process of the invention where the reaction is conducted at a relatively high temperature in the reaction zone (or at least in the last reaction zone traversed by the charge in case of a plurality of zones), we have discovered that it is very advantageous to recycle to the reaction zone (or to the last reaction zone through which passes the charge in the case of a plurality of reaction zones) the $C_6$ and $C_7$ hydrocarbons withdrawn from the top of the extractive distillation zone, used in the present process for obtaining benzene and/or toluene; this $c_6$–$C_7$ fraction is therefore advantageously recycled even if it still contains small amounts of $C_8^+$ which will be further converted in the reaction zone to aromatic hydrocarbons.

EXAMPLE

The following non limitative example illustrates the invention with reference to the accompanying drawing also given in a non limitative way.

The figure of the drawing is a very diagrammatical one since the operating manner is easy to understand. It shows three reactors 1, 2 and 3 operated in fixed bed, the fourth reactor 4 being of the moving bed type. The feed charge, whose travel path is not shown, passes successively through reactor 1, then reactor 2, then reactor 3 and finally through reactor 4. Between consecutive reactors, the charge passes through a heating means, not shown.

Accordingly, a given charge is successively treated in four reactors, three being of the fixed bed type and the fourth of the moving bed type.

The initial feed charge had the following characteristics:

| | |
|---|---|
| Specific gravity at 20°C | 0.739 |
| Distillation ASTM | IP:76°C<br>FP: 161°C |
| Composition by volume | paraffins : 59.74 %<br>naphthenes : 30.44 %<br>aromatics : 9.82 % |

This charge is treated, in the presence of a catalyst, in the three reforming reactors 1 to 3 in the following operating conditions:

| | | |
|---|---|---|
| Pressure | | 15 bars |
| Flow rate of the charge | | 3 kg per kg of catalyst per hour |
| Molar ratio hydrogen/hydrocarbon | | 5 |
| Temperatures | First reactor | inlet : 500°C<br>outlet : 440°C |
| | Second reactor | inlet : 500°C<br>outlet : 468°C |
| | Third reactor | inlet : 500°C<br>outlet : 490°C |

These three reactors are operated with a fixed bed and the catalyst used in each of these reactors contains 0.35% by weight of platinum, with respect to the carrier which consists of alumina having a specific surface of 240 $m^2/g$ and a pore volume of 57 cc/g. The catalyst further contains 0.04% by weight of iridium. The chlorine content of this catalyst is 1%.

The product issued from the third reactor is sent and treated in the fourth reactor containing a catalyst having the same composition as that used in the proceding reactors, the alumina being in the form of balls, the fourth reactor being operated according to a regenerative system (the catalyst is distributed between the four reactors in the following ratio : 1st reactor : 10%; 2nd reactor : 20%; 3rd reactor : 30%; 4th reactor : 40%.

The operating conditions in the fourth reactor are as follows:

| | |
|---|---|
| Pressure | 10 bars |
| Flow rate of the charge | 3.5 kg per kg of catalyst per hour |
| Molar ratio hydrogen/hydrocarbons | 5 |
| Temperatures | inlet : 580°C<br>outlet : 540°C |

The catalyst is withdrawn continuously from this reactor, through duct 6, at a rate of about one four-hundredth of the total catalyst content of the reactor per hour. Then the catalyst withdrawn from the bottom of the fourth reactor is conveyed by a mechanical lift 8 to an "accumulator-decantor" drum 9 where the conveying gas, introduced through duct 7 (the conveying gas is recycle hydrogen issuing from the reaction section) is separated from the catalyst. The used catalyst accumulates in the accumulator-decantor drum before being fed through duct 10 to a regenerator 11 placed below said drum; at regular time intervals, the pressure in the regenerator is balanced with that of the accumulator-decantor drum. The regenerator is then filled with catalyst conveyed through a system of valves from the accumulator-decantor drum and then isolated from the rest of the system. Optionally the regenerator is scavenged with nitrogen for eliminating the hydrocarbons carried away in the lift. Then the regeneration is performed in three successive steps in fixed bed according to the method described in the U.S. Patent Application Ser. No. 305,797 filed on Nov. 13, 1972, comprising:

1. A first stage performing the combustion of coke: the inlet temperature of the regenerator is maintained at 440°C, the pressure in the regenerator at 5 $kg/cm^2$ absolute, the oxygen content at the inlet of the regenerator at 0.3 % by volume, said stage extending over 1 h 30.

2. A second stage of oxychlorination by simultaneous injection of oxygen and $CCl_4$: the temperature at the inlet of the regenerator is maintained at 510°C, the pressure in the regenerator at 5 $kg/cm^2$ absolute, the oxygen content at the inlet of the regenerator being from 2 to 2.5 % by volume, the $CCl_4$ injection being carried out at a rate of 3.4 kg/h. The duration of said second stage is 1 hour.

3. A third stage of performing a new oxidation: the temperature is maintained at 510°C, the pressure at 5 $kg/cm^2$ absolute, the oxygen content at the regenerator inlet being from 4.5 to 6.0 % by volume and the duration of said stage being 1 hour.

After said third stage, the regenerator is scavenged with nitrogen and then its pressure is balanced with that prevailing in the fourth reactor. The catalyst is transferred by means of a lift from the regenerator to this reactor. At the top of this reactor, in a separate compartment, the catalyst is reduced by means of a hydrogen stream (hydrogen flow rate: 25 kg/h), at 500°C under a pressure of 13 $kg/cm^2$ absolute. Then fresh catalyst is progressively introduced into this reactor at a rate of about one four-hundredth of the total catalyst content of the reactor per hour.

When operating according to the above-mentioned conditions, there is obtained, at the outlet from the fourth reactor, a product having the following composition by weight:

| | |
|---|---|
| - Hydrogen | 2.21 |
| - Methane | 3.87 |
| - Ethane | 2.56 |
| - Propane | 6.57 |
| - Isobutane | 4.24 |
| - n-butane | 5.56 |
| - Isopentane | 3.58 |
| - n-pentane | 1.44 |
| - Isohexanes | 2.01 |
| - n-Hexane | 0.78 |
| - Isoheptanes | 0.27 |
| - n-Heptane | 0.04 |
| - Isooctanes | 0.02 |
| - n-Octane | — |
| - Isononanes | — |
| - n-Nonanes | — |
| - Methylcyclopentane | 0.22 |
| - Cyclohexane | 0.03 |
| - Methylcyclohexane | — |
| - Σ dimethylcyclopentane | — |
| - $C_8$ Naphthenes | — |
| - $C_9$ Naphthenes | — |
| - Benzene | 11.37 |
| - Toluene | 24.47 |
| - Ethylbenzene | 1.84 |
| - Σ Xylenes | 21.77 |
| - Σ $C_9$ aromatics | 5.02 |
| - Σ $C_{10}$ aromatics | 2.13 |
| | 100.00 |

It corresponds to the production of 57.61 kg of benzene, toluene and xylenes for 100 kg of initial feed charge.

The effluent from the fourth reactor, withdrawn through duct 15, is then subjected to a series of fractionations: first of all we separate the normally gaseous products in the flask 16 and column 19, we distillate the liquid phase in a column 22, the top product from column 22 is the $C_6$ cut which is sent through duct 23 to the extractive distillation zone 31, the toluene, ethylbenzene-xylenes and $C_9^+$ cuts recovered from the bottom of column 22 are rectified in columns 25 and 28.

For 100 kg of effluent from the fourth reactor we obtain 15.21 kg of light products, 14.82 kg if $C_4$–$C_5$ cut, 24.47 kg of toluene, 23.61 kg of an ethylbenzene-xylene cut, 7.15 kg of a $C_9^+$ cut and 14.78 kg of the $C_6$ cut having the following composition:

| | |
|---|---|
| i $C_6$ | 2.01 kg |
| n $C_6$ | 0.78 kg |
| i $C_7$ | 0.27 kg |
| n $C_7$ | 0.04 kg |
| i $C_8$ | 0.02 kg |
| Methylcyclopentane | 0.22 kg |
| Cyclohexane | 0.03 kg |
| Benzene | 11.37 kg |

The $C_6$ cut is used as feed charge for an improved extractive distillation unit of the type described in the U.S. Patent Application Ser. No. 343,108 filed on Mar. 20, 1973: In the extractive distillation according to this patent application, there is used in addition to an extraction solvent, an associated solvent, water, in the form of vapor; the extractive distillation process is then characterized in that the mixture of aromatic hydrocarbons to be separated is introduced through duct 23 into an extractive distillation zone 31, at an intermediary point thereof, the extraction solvent is introduced through duct 32 at a point of the extractive distillation zone above the point of introduction of the hydrocarbon mixture, the associated solvent is introduced in the form of slightly overheated vapor, through the vaporizer 34 and duct 33 at a point of the distillation zone above the point of introduction of the extraction solvent, the top product from the distillation column, or distillate, is condensed at 36, withdrawn through duct 35 and the resulting condensate is separated in 37 into two liquid phases, a first phase containing non-aromatic hydrocarbons and a second phase containing the associated solvent, the first phase is separately withdrawn through duct 38 and the second phase through duct 39, the bottom product of said distillation zone, containing the aromatic hydrocarbons and the extraction solvent is discharged through duct 41 and the solvent is separated from the aromatic hydrocarbons in a known manner to obtain, on the one hand, the recovered extraction solvent, and, on the other hand, the aromatic hydrocarbons.

In the present example, the operation is as follows:

The extractive distillation column consists of a column with 70 plates. Dimethylformamide, acting as extraction solvent, is injected at the level of the $55^{th}$ plate, at a temperature of 85°C, so that the ratio of the respective flow rates of the solvent and the feed charge is 2.5 by weight. We also inject into the column at the level of the $61^{st}$ plate, water vapor at a flow rate of 0.69 kg/h.

The distillation is carried out with a reflux rate of 1.

The top effluent of this column, withdrawn at a rate of 3.44 kg/h, is condensed and decanted in two phases: a lower phase consisting of water which is recycled to the extractive distillation column through duct 40 and an upper phase consisting substantially of all the non-aromatic hydrocarbons initially present in the benzene mixture. Its composition is given in table I below.

The bottom product of the extractive distillation column is sent to a second column having 40 plates and operated with a reflux rate of 0.75. From the bottom of said second column we withdraw dimethylformamide which is recycled to the first column and, at the top, we withdraw at a rate of 11.37 kg/h, purified benzene whose composition is given in table I:

TABLE 1

| Hydrocarbons | Feed charge | Top of extractive distillation column | Top of solvent regeneration column |
|---|---|---|---|
| i $C_6$ | 13.62 | 13.62 | — |
| $C_6$ | 5.29 | 5.29 | — |
| i $C_7$ | 1.83 | 1.83 | — |
| n $C_7$ | 0.27 | 0.27 | Traces |
| i $C_8$ | 0.14 | 0.13 | 0.003 |
| Methylcyclopentane | 1.49 | 1.49 | — |
| Cyclohexane | 0.20 | 0.20 | — |
| Benzene | 77.16 | 0.30 | 76.85 |

The final production of pure benzene is 11.37 kg/h for 100 kg of initial feed charge. However, if after having first condensed the distillate obtained at the top of the extractive distillation column and then separated the phase containing the associated solvent (water), 90% of the phase containing the non-aromatic hydrocarbons is recycled to the fourth reactor through duct 38 after preliminarily washing with water and drying of the phase containing the non-aromatic hydrocarbons, the washing and drying means being not shown on the FIGURE, the final benzene production increases from 11.37 kg/h per 100 kg of initial feed charge to 12.14 kg/h per 100 kg of initial feed charge, i.e. a relative gain of 6.8 % by weight. When recycling the 90 % of the phase containing the non-aromatic hydrocarbons to the third reactor (after preliminary washing with water and drying of the phase containing the non-aromatic hydrocarbons), the final benzene production is only 11.25 kg/h per 100 kg of initial feed charge.

When recycling to the fourth reactor 80 % of the phase containing the non-aromatic hydrocarbons (after preliminary washing with water and drying of the phase containing the aromatic hydrocarbons) the final benzene production amounts to 12.10 kg/h per 100 kg of initial feed charge.

When we recycle to the fourth reactor 90 % of the phase containing the non-aromatic hydrocarbons (after washing and drying of this phase), we obtain:

12.19 kg/h per 100 kg of initial feed charge when the fourth reactor is operated with an inlet emperature of 583°C and an outlet temperature of 545°C.

11.89 kg/h per 100 kg of initial feed charge, when the inlet temperature of the fourth reactor is 590°C and its outlet temperature 545°C.

12.05 kg/h per 100 kg of initial feed charge when the inlet temperature of the fourth reactor is 570°C and its outlet temperature 540°C.

We claim:

1. A process for producing aromatic hydrocarbons in which a feed charge containing essentially paraffinic and naphthenic hydrocarbons and aromatic hydrocarbons is subjected to a treatment with hydrogen in at least two reaction zones in the presence of a catalyst, the inlet temperature of at least the last reaction zone traversed by the charge being from 570° to 600°C, the pressure from 1 to 60 kg/cm², the hourly flow rate by volume being from 0.1 to 10 times the catalyst volume and the molar ratio of the hydrogen to the hydrocarbons being from about 0.5 to 20, in which process the obtained products are made free from normally gaseous products and then subjected to at least one conventional fractionation so as to obtain a fraction containing essentially hydrocarbons having 4 and 5 carbon atoms per molecule, fractions or mixtures of fractions containing essentially at least one aromatic hydrocarbon selected from toluene, ethyl-benzene and xylenes, and aromatic hydrocarbons containing at least 9 carbon atoms per molecule, and a cut containing essentially, in addition to saturated hydrocarbons consisting essentially of 6 and/or 7 carbon atoms per molecule, a fraction selected from the benzene, toluene and benzene-toluene fractions, said process further comprising subjecting, in an extractive distillation zone, said cut to an extractive distillation in the presence of a suitable extraction solvent, recovering at the bottom of the extractive distillation column a mixture of the extraction solvent and at least one aromatic hydrocarbon, separating said aromatic hydrocarbon from the extraction solvent and recovering, at the top of the extractive distillation zone, a new cut containing non-aromatic products, said process further comprises subjecting said new cut containing the non-aromatic hydrocarbons consisting essentially of saturated hydrocarbons having 6 and/or 7 carbon atoms per molecule to a condensation, removing therefrom at least the major part of the extraction solvent contained therein and recycling at least one portion of the so-purified cut containing the said non-aromatic hydrocarbons towards the last one of the reaction zones, wherein the inlet temperature is comprised between 570° and 600°C, the catalyst of at least said reaction zone, to which said so-purified cut is recycled, containing at least two metals from group VI B, VII B or VIII of the periodic classification of elements, the concentration of each metal being comprised between 0.01 and 5% by weight.

2. A process according to claim 1, wherein the feed clarge is subjected to a treatment with hydrogen in two reaction zones and wherein the said so-purified cut is recycled towards the last reaction zone.

3. A process according to claim 2, in which the inlet temperature of at least the last reaction zone is from 570° to 585°C.

4. A process according to claim 1, as used for the production of benzene.

5. A process according to claim 1 as used for the production of toluene.

6. A process according to claim 1, in which said new purified cut containing non-aromatic hydrocarbons is recycled at least partly to the last reaction zone after a preliminary washing with water and drying.

7. A process according to claim 2 in which, in each reaction zone, the catalyst contains at least two metals selected from the metals of groups VI B, VII B and VIII of the periodic classification of elements.

* * * * *